United States Patent [19]

Warner et al.

[11] 4,371,589

[45] Feb. 1, 1983

[54] PROCESS FOR DEPOSITING PROTECTIVE COATING AND ARTICLES PRODUCED

[75] Inventors: Joshua B. Warner, Spartanburg; James S. Wolf, Clemson, both of S.C.

[73] Assignee: Warner London Inc., Spartanburg, S.C.

[21] Appl. No.: 31,797

[22] Filed: Apr. 20, 1979

Related U.S. Application Data

[63] Continuation of Ser. No. 717,394, Aug. 24, 1976, abandoned.

[51] Int. Cl.[3] ..... B22F 7/04

[52] U.S. Cl. ..... 428/553; 428/548; 428/550; 428/557; 428/559; 428/560; 428/561; 428/562; 428/566; 428/636; 428/637; 428/638; 428/646; 428/651; 428/656; 428/661; 428/663; 428/664; 428/666; 428/678; 428/674; 428/680; 428/681; 428/684; 428/685; 428/148; 428/195

[58] Field of Search ..... 428/548, 550, 553, 557, 428/559, 560, 561-562, 566, 636-638, 646, 651, 656, 661, 663, 664, 666, 678, 674, 680, 681, 684, 685, 148, 195

[56] References Cited

U.S. PATENT DOCUMENTS

| | | | |
|---|---|---|---|
| 2,990,293 | 6/1961 | Joulmin | 428/553 X |
| 3,248,251 | 4/1966 | Allen | 428/559 |
| 3,689,987 | 9/1972 | Teague | 428/553 X |
| 3,723,078 | 3/1973 | Parker | 428/553 X |
| 3,988,119 | 10/1976 | Takahashi et al. | 428/553 X |
| 3,989,863 | 11/1976 | Jackson et al. | 428/553 X |

*Primary Examiner*—Joseph L. Schofer

*Assistant Examiner*—J. L. Barr

*Attorney, Agent, or Firm*—Lalos, Leeds, Keegan, Lett & Marsh

[57] ABSTRACT

An article of improved wear characteristics and composed of a relatively low wear resistant base metal coated by a particulate refractory metal having a melting point of at least 1490° C. deposited within the near-surface region thereof comprising a base metal or alloy of relatively low wear resistance, a refractory metal deposited within said near-surface region, said refractory metal being selectively deposited in the form of discrete particles, and the particles being idiomorphic or blocky or equiaxial or spheroidal or acicular or dendritic and a plurality of these particles having dimensions of less than 10 micrometers, a plurality of the particles being contiguous to form clusters of the particles that are spaced from each other. The clusters of particles may form microscopic regions of refractory metal which in turn may produce macroscopic regions of refractory metal having the appearance of a continuous coating. The refractory metal is selected from the group including: boron, chromium, cobalt, iridium, molybdenum, niobium, osmium, palladium, platinum, rhenium, rhodium, ruthenium, tantalum, thorium, titanium, tungsten, vanadium, yttrium, and zirconium and all alloys incorporating these refractory metals.

The process of providing protective coatings of refractory metals and alloys on to any metallic base such as: iron, aluminum, chromium, cobalt, copper, nickel, magnesium, tin, titanium, or on to any metallic alloy base such as: steels, cast irons, brasses, bronzes, and solders at temperatures as low as ambient or below, including selecting an electrolyte material capable of dissociation into ions, such that at 25° C. the equivalent conductance of 0.1 normal solution of electrolyte divided by that of the electrolyte solution at infinite dilution is between 0.13 and 0.93, providing a particulate refractory metal having a melting point of at least 1490° C., to be deposited within the near-surface region of the base metal, admixing 99 to 50 percent by weight of said refractory metal and 1 to 50 percent by weight of said electrolyte, the refractory metal having a nascent surface capable of producing ions in solution, ionizing said refractory metal to a concentration of about 1 to 60,000 mg. of refractory metal per liter of solution, and at least partially surrounding said refractory metal with said electrolyte, contacting and at least partially coating the base metal with the refractory metal and the electrolyte admixture, reacting the electrolyte in the admixture with the base metal at temperatures between 0° C. and 200° C., and depositing discrete particles that may be randomly distributed or may appear as clusters of particles forming a coating of microscopic or macroscopic metallic regions of said refractory metal within the near-surface region of the base metal, whereby to provide a protective and wear-resistant surface for the base metal.

30 Claims, 1 Drawing Figure

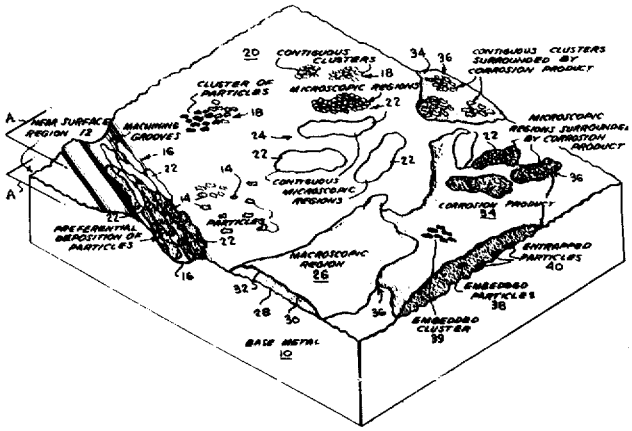

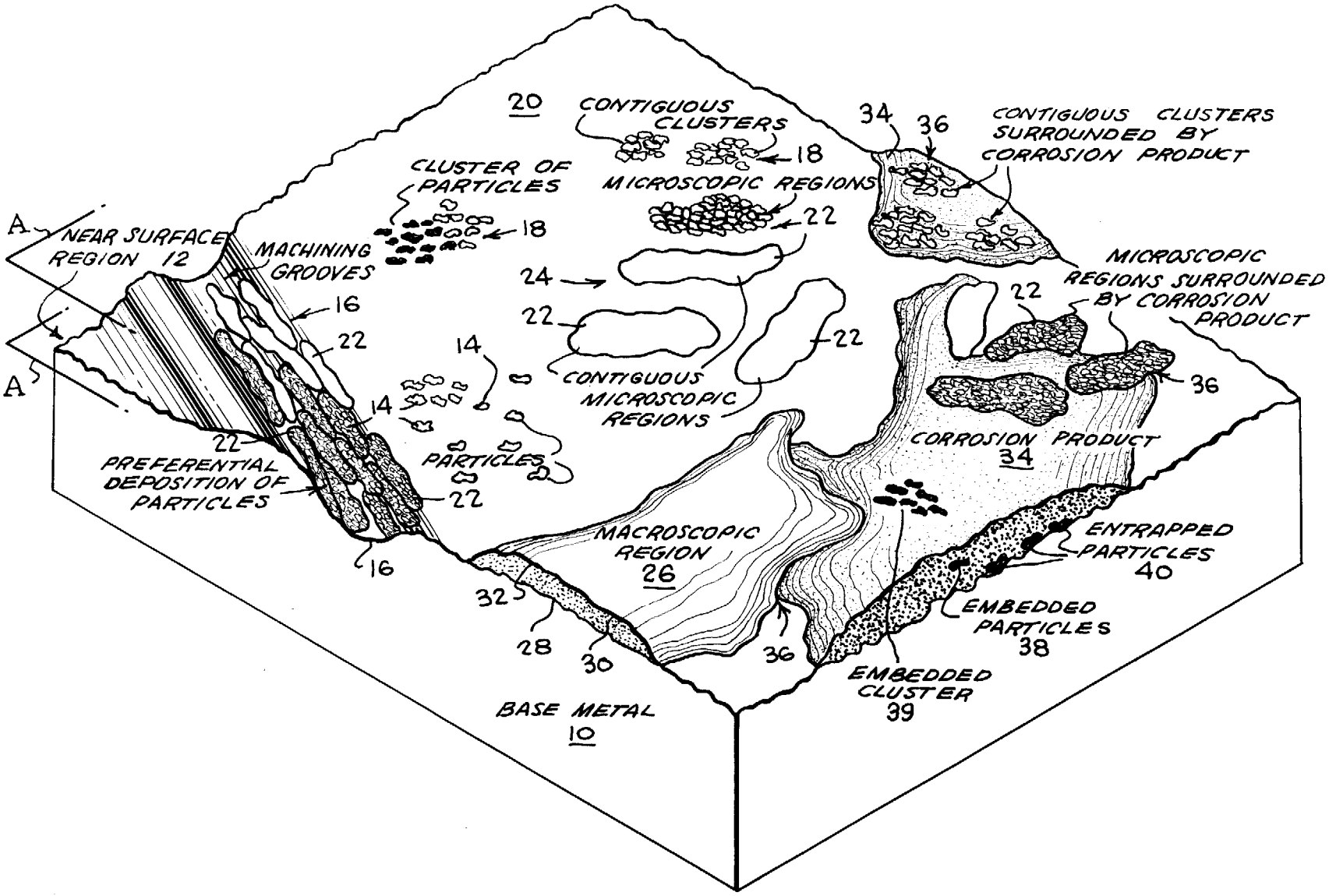
CONTIGUOUS CLUSTERS SURROUNDED BY CORROSION PRODUCT
MICROSCOPIC REGIONS SURROUNDED BY CORROSION PRODUCT
CORROSION PRODUCT 34
ENTRAPPED PARTICLES 40
EMBEDDED PARTICLES 38
EMBEDDED CLUSTER 39
CONTIGUOUS CLUSTERS
MICROSCOPIC REGIONS
CONTIGUOUS MICROSCOPIC REGIONS
MACROSCOPIC REGION 26
BASE METAL 10
CLUSTER OF PARTICLES
PARTICLES
MACHINING GROOVES
NEAR SURFACE REGION 12
PREFERENTIAL DEPOSITION OF PARTICLES
20
18
22
24
14
16
30
28
32
34
36
A
A

PROCESS FOR DEPOSITING PROTECTIVE COATING AND ARTICLES PRODUCED

This is a continuation of application Ser. No. 717,394, filed Aug. 24, 1976, now abandoned.

BACKGROUND OF THE INVENTION

This invention relates generally to protective coatings. More particularly, the present invention relates to discontinuous coatings of refractory metal particles such as abrasion-resistant, heat-resistant, or chemical resistant, or the like, materials, applied to surfaces that may be composed of metal, metallic alloys, and metal containing bases and the like.

Refractory metal coatings applied to base metals are particularly desirable to achieve a wear resistance that is not characteristic of the base metal. It is known that wear processes involving metal surfaces produce high temperatures at microscopic surface locations due to friction. These temperatures may often be beyond the melting point of particular base metals and therefore lead to undesirable surface changes, but are not above the melting points of the useful refractory metals. A base metal covered or protected by a refractory metal coating can therefore achieve a longer useful and economical life.

It is known in the art to apply metal coatings such as through metal diffusion processes for coating of other metals. Essentially, these processes utilize a powdered or otherwise finely divided impregnating material which may be a powdered metal, for example, and usually a source of volatile or vaporizable halogen-bearing substance. The various processes differ in many respects, but all the metal diffusing processes have one important factor in common, and that is, the temperature to which the potential metal coating and/or the metal surface to which it is to be applied, must be raised to a high degree. This temperature is usually in the range between 300° C. and 1000° C. in order to effect the diffusion of the coating metal upon the base.

While many of these processes are somewhat successful, they suffer from a number of disadvantages. Among these is the requirement of the extremely high temperature which necessarily will limit not only the type of material that may be used to form the coating, but also the surface of the article to be coated must be able to withstand exposure to such high temperature no matter how short the period of time.

None of these processes is adaptable for use with a significantly wide range of refractory materials, nor are any of the prior art metal diffusion processes capable of performing at any temperature but high temperature. Moreover, the limited applicability of the process to only those metal bases which are able to withstand the high temperature precludes a number of applications to metallic materials having relatively low melting temperatures. The application of refractory metals as protective coatings is also frequently difficult and uneconomical because a number of the refractory metals such as tungsten and molybdenum are prone to reaction with the atmosphere at high temperatures. Special equipment is therefore normally required to carry out processes involving these types of metals. For example, vacuum or inert atmosphere furnaces are frequently used.

There are other methods of applying a hard facing or other refractory coating to various base materials including flame-spraying processes, electroplating, dipping, or the like. Additionally, providing inserts of harder material in the softer to-be-protected material is an age-old technique still very prevalent in industry today.

While some of these methods may offer some protection for the article if the refractory coating can actually be applied successfully, they result in a particular disadvantage when the article to be coated is of a previously carefully shaped and proportioned size. The size and proportion may be critical but the added protective material will substantially alter the dimensions of the base article to an extent readily detectable by standard machine shop practice. The coated article may then require subsequent grinding or other processing to resurface and redimension the article. Obviously, this would not be acceptable to industry if the article were originally of a desired shape either in present use or adapted for immediate use, since any grinding or removal of the coating material to restore the original size and dimensions of the uncoated article would bring about a loss of the very protection that the refractory material is to provide.

Surface roughness is also a problem of concern. For instance, the roughness of the protective coating under the various prior art methods has been for some applications unacceptable even though the physical appearance of the surface deposit may seem to be smooth. While it may pass the inspection of the naked eye, or by touch, undesirable roughness is often found under high magnification or is evidenced by poor performance in service. This roughness may be in the form of protrusions of metal that have been found to have a tendency to flake and spall under abrasion, resulting in a loss of protection for the base metal.

Other disadvantages and drawbacks to prior art coatings and protective applications are the extreme brittleness of some coatings or materials which have been applied to achieve hardness, thus rendering the article to which such coating is applied impractical for use where any impact or bending is applied. One well-recognized fault of such coatings is their tendency to crack or spall from the substrate during service applications of the coated material.

Electroplating is another widely used coating procedure but inherent in this electrolytic process are a number of disadvantages other than the obvious requirements of careful controls and expensive electrical equipment. The electroplating process is basically limited to those metals that produce a substantial concentration of metal ions in an electrolyte bath. For some important metals (e.g., molybdenum, niobium, tantalum, titanium, tungsten and zirconium), the electrolyte is usually a molten salt bath to achieve this ion concentration, requiring great energy input not only in electric current but also in heat to maintain a molten condition. Other metals are limited by reason of their position in the electromotive series. Further, many practical applications necessitate the use of an electrolyte having a good throwing power in order to plate recessed or remote surfaces. Another major drawback associated with the electrodeposition of refractory materials from aqueous solutions is the low electrode efficiency which can be as small as a few percent for certain of the refractory metals. Such low efficiencies make the plating of refractory materials from aqueous solutions uneconomical.

The electroplated product is inherently a continuous coating but one that is not of uniform thickness due to the variations in current density produced by the shape and form of the plated article. In spite of the apparent continuity, the non-uniformity of the coating creates undesirable dimensional changes in the finished product, and in many cases generates residual stresses in the coating which, directly or indirectly, lead to cracking or spalling of the coating.

Small parts pose a particular problem for any electroplating process since each part must be electrically connected to a source of electrical current. To connect a great number of small knives, textile machine travelers or other small parts separately is at least an uneconomical task and even if performed the connection will leave an unplated area of the part. The alternative method of barrel plating small parts requires further expenditure for specialized equipment and has inherent limitations involving: non-uniform coating thickness, part shape limitations, and deleterious effects of part rusting.

OBJECTS OF THE INVENTION

It is, accordingly, an object of the present invention to provide an inexpensive and economical process for the application of refractory metals to the surface of base metals at low temperatures including ambient temperatures.

A further object of the present invention is the provision of a process and a coated article in which a refractory metal is applied to the surface of various metals or metal-containing materials as a coating of discrete refractory metal particles to produce a smooth, low-friction, wear-resistant, chemically-resistant, or rust-resistant, or the like, protective coating.

A further and important object of this invention is the provision of a method that will coat a base metal with discrete particles in a discontinuous pattern or selectively produce a substantially or apparently continuous wear-resistant and corrosion-resistant coating.

Another object of the present invention is to provide a method of applying a protective or refractory metal to a base surface without noticeably changing the exterior dimensions of the base as determinable by standard machine shop practice.

This invention also has as an object the provision of a method and the article so produced which enables the application of a refractory metal, including those considered difficult to electroplate, to substantially any base metal or metal-containing materials at ambient temperature to produce an adherent deposit of refractory metal without the need for expensive electroplating equipment.

A further object of this invention is the provision of a method for producing plural coatings of refractory metals onto a metal or metal-containing base.

Another and more specific object of this invention is the provision of a method for treating small metal articles or parts to produce a more wear-resistant surface.

THE DRAWING

The FIGURE is a schematic representation of various possible structural characteristics of the near-surface of the base metal.

DESCRIPTION OF THE INVENTION

The Process

The present invention is the unique discovery that any metal, metallic alloy or metal-containing base may have deposited thereon a refractory or protective metal having a melting point of at least 1490° C. when combined with an electrolyte that is at least in part positioned between the refractory metal particle and the surface of the base material.

Among those refractory or protective metals that may be used are the following in powder or particulate form and all alloys incorporating these boron
chromium
cobalt
iridium
molybdenum
niobium
osmium
palladium
platinum
rhenium
rhodium
ruthenium
tantalum
thorium
titanium
tungsten
vanadium
yttrium
zirconium The initial shape of these metal particles is any one of the following, idiomorphic or blocky or equiaxial or spheroidal or acicular or dendritic and they are preferably of as small a size as practicable, usually in the range of 0.01 micrometer to about 1 mm. The base materials upon which the refractory material may be deposited include any of the metals, such as: aluminum, iron, chromium, cobalt, copper, nickel, magnesium, titanium, or any alloy of these, including: steels, cast irons, brasses, bronzes, solders, etc., or any other suitable base metal.

In order to effect the deposition of particulate refractory metal within the near-surface region of the base, it is also necessary that there be present a finely dispersed electrolyte material which should be positioned at least partially between the particulate refractory metal and the base metal. It has been postulated that an action which may be characterized as electrochemical occurs among the refractory metal in the form of both ions and neutral particles, the electrolyte, and the base metal. It is believed that within the minute regions wherein the particulate refractory metal is adjacent the base metal, but separated by the electrolyte and the ions resulting from solution of the refractory metal (hereinafter referred to as "refractory metal ions"), that a micro-electrolysis takes place possibly in the form of an exchange reaction which deposits the particulate refractory metal within the near-surface region of the base metal.

Among those electrolytes found suitable are the acids including: the mineral acids, hydrochloric, nitric, sulphuric, phosphoric, perchloric, fluorosilicic, etc., and the acid anhydrides such as arsenic trioxide and chromium trioxide, etc.; the organic acids, tartaric, malonic, and the like. Useful basic electrolytes include: alkali and alkaline earth hydroxides such as sodium, potassium, lithium, calcium, magnesium, etc. Also useful as electrolytes are: alkali and alkaline earth salts of the acids set forth above, such as the alkali halide salts, particularly the chlorides, chlorates, fluorides, nitrates, sulfates, phosphates, carbonates, etc. and metal salts, wherein the metal now used as a part of the electrolyte may be any one of the metals mentioned previously as a refractory metal or as a base metal, forming any salt such as the sulfates, phosphates, nitrates, carbonates, chromates, molybdenates, tungstates, etc.

Also found useful as the electrolyte are the chemical compounds such as ammonium thiocyanate, potassium thiocyanate, zinc sulfate, ammonium carbonate, ammonium sulfate, potassium sulfate, sodium sulfite, sodium carbonate, potassium cyanide, calcium nitrate, potassium chloride, and calcium chloride.

While the electrolyte may be generally any acid, base or salt, it must dissociate in the presence of moisture, i.e., be capable of conducting electrical current and have an adequate degree or percentage of dissociation or more correctly a sufficiently high equivalent conductance ratio.

For purposes of this invention, the conductance ratio is determined as the ratio between the equivalent conductance at a dilution of 1 gm-equivalent per 10 liters of water and the equivalent conductance at infinite dilution, the temperature being 25° C. (see "The Physical Chemistry of Electrolytic Solutions", Harned and Owen, Rheinhold Publishing Corp., 1958). The electrolytes that are useful in the present invention are those having conductance ratios in the range of 0.13 to 0.93 approximately, and preferably above 0.60.

The following are some of the acids, bases and salts and the approximate values of their corresponding equivalent conductance ratios that meet the requirements of this invention:

| ACIDS | | BASES | |
|---|---|---|---|
| hydrochloric acid | 0.90 | sodium hydroxide | 0.88 |
| nitric acid | 0.92 | potassium hydroxide | 0.93 |
| sulfuric acid | 0.60 | calcium hydroxide | 0.80 |
| | | strontium hydroxide | 0.86 |
| | | barium hydroxide | 0.86 |
| SALTS | | | |
| silver nitrate | 0.86 | sodium carbonate | 0.61 |
| potassium chloride | 0.86 | ammonium sulfate | 0.59 |
| sodium chloride | 0.82 | barium nitrate | 0.57 |
| potassium bromide | 0.92 | strontium nitrate | 0.62 |
| sodium nitrate | 0.82 | lead nitrate | 0.54 |
| sodium acetate | 0.79 | cupric acetate | 0.33 |
| potassium chlorate | 0.83 | zinc sulphate | 0.38 |
| calcium chloride | 0.75 | copper sulphate | 0.38 |

Because dissociation is a criterion for the selection of an electrolyte in this process, it may be concluded that the greater the capability of the dissociation of the electrolyte, the more effective it would become in causing the reaction of this process to take place. The assumption here is that the more complete the ionization of an electrolyte may be, the more effectively will it serve the purposes of this process.

Insofar as this process is concerned, no electrical current need be applied in depositing the refractory or protective metal within and upon surfaces; however, because this process is believed to be fundamentally electrolytic in nature, the application of an electrical current will influence and may assist this process. An applied current is not a requisite of the process as the internally-generated electrolytic currents are of sufficient magnitude on a microscopic scale to obtain the results of this invention.

In order to achieve the electrochemical reaction for the deposit of the refractory metal upon the base material, it is believed that an intimate association between the particulate refractory metal, the electrolyte, and the base material takes place. In this respect, it has been found for the case of solid electrolytes that the precise combined particle size of the electrolyte and refractory metal is not critical or important as this size depends primarily upon the dimensions of the usually harder refractory metal. The electrolyte particle is preferably finely divided and in the range of $10^{-3}$ micrometer to approximately 1 mm, preferably 10 to 100 times smaller than the conjugate refractory metal particle at the time of the application to the base metal.

To initiate the reaction in which it is believed that a portion of the base metal is exchanged for the refractory metal, it is important that the refractory metal become partially ionized to effect the exchange reaction with the base metal. It has been found that the ion concentration should be in the range of 1 to 60,000 mg of refractory metal ion per liter of solution. Preferably, the range should be between 1,000 and 15,000 mg of refractory metal ion per liter of solution.

The refractory metal ion, after it has exchange-reacted with the base metal, is believed to provide a site for the particle of refractory metal to be deposited. These reactions are thought to occur only on a microscopic scale. In order to produce refractory metal ions, at least in sufficient quantity to bring about the desired reactions, it is important that the refractory metal have a nascent surface on at least a portion of the surface of the refractory metal particle to be deposited. This fresh surface, for reasons that cannot be fully explained, enables the refractory metal in combination with the electrolyte and the moisture present to produce in sufficient time the necessary concentration of refractory metal ions. All of the refractory metals are insoluble, in the usual sense of the term, in the moisture present but sufficient concentrations of ions as required for this invention are nevertheless produced from the nascent surfaces of the refractory particles in the presence of the electrolyte and sufficient moisture. The nascent surface required can be easily produced by a mechanical action such as mulling, milling, or other admixing, abrading, or by chemical action of the electrolyte or other reactive material which forms a nascent surface on the refractory metal particle.

The amount of mechanical or chemical action to produce the nascent surface is not critical since some nascent surface would be produced by any such mixing actions. From the nascent surface the refractory metal ions will be produced in a time span of about 1 minute to 30 days, preferably 1 to 20 hours, the time depending upon the amount of moisture, the temperature and the solubility of the refractory metal. The time is therefore not critical. It is important only that the necessary concentration of refractory metal ions be present and that some nascent surface be produced whereby the particulate refractory metal may be deposited within the near-surface region of the base metal.

To provide the intimate relationship between the electrolyte and the particulate refractory metal and to position the electrolyte between the surface of the base metal and the refractory metal, as well as cause more nascent surface to be exposed on the particles of refractory metal, several alternate methods are possible. When the refractory metal is in the physical state of a dry powder under ambient conditions, and the electrolyte is also in a sensibly dry granule form, an intimate mixture may be achieved by thoroughly mixing the two powders together. The range of amounts of the refractory metal is from 99% to 50%, preferably 96% to 66% by weight, of the dry mixture of refractory metal and electrolyte. The electrolyte may range from 1% to 50%, and preferably 4% to 34% by weight of the dry mixture of the refractory metal and the electrolyte.

It has been found that to enhance the electrochemical action of this invention an element or compound which acts as an agent for preventing electrochemical polarization may be incorporated optionally with the particulate refractory metal and electrolyte in the amount of 1 to 10% by weight of the total refractory metal and electrolyte admixture. Examples of such depolarizing compounds or elements are $MnO_2$, platinum metal powder, CuO, HgO, ionizable iron or tin salts such as the halides, sulfates, nitrates, etc. thereof and activated carbon.

To intimately mix the electrolyte and the refractory metal when both are in convenient granule or powder form, it has been found that mulling or ball milling of the dry materials results in coating or smearing of one particle over the surface of another particle usually, for instance, the coating of the softer electrolyte particle over the harder refractory metal. In such event, the refractory metal particle would have a coating of the electrolyte so that the contact of the refractory metal with the base metal would be indirect, or through the coating of electrolyte material on the refractory metal particles. When a liquid phase is present, contact is made through the refractory metal ions that, as is believed, provided the sites for the particles to be deposited within the near-surface region of the base.

The thickness of the electrolyte coating upon the refractory particle should be as continuous and uniform as possible and may be from molecular films to 25 micrometers or thicker up to 1 mm. Preferably, a major portion of the refractory metal surface is to be coated although a minor portion as low as about 10% is acceptable.

Mulling is one of the methods of achieving a substantially even distribution of the electrolyte material on or about the refractory metal. Muller-type mixing apparatus are well known to effect a thorough blend of materials. Even a mixing action of the type provided by a mortar and pestle has been shown to be suitable to achieve the intimate association and coating of electrolyte onto the particulate refractory metal. Other mixing or compounding methods such as ball milling are also suitable to coat the refractory metal particles with the electrolyte.

It has been found that the mixing or mulling to produce either or both the nascent surfaces on the refractory metal particle and the coating of the refractory particle with electrolyte powder may occur when both the electrolyte and refractory metal powders are sensibly dry having little or no observable moisture. This mixing period will usually be about 30 minutes to 30 days. But to produce the refractory metal ions there must be adequate moisture present or the ions will not form.

Whether either or both of the refractory metal and electrolyte is dry under ambient conditions, water should be present in the refractory metal-electrolyte mixture in the amount of about 0.5% to 60% by weight of the total mixture prior to the treatment of the base metal with the mixture. Preferably the amount of moisture should be 1% to 40% by weight.

It is also feasible to achieve the benefits of the present invention by forming an intimate wet addition of the electrolyte and refractory metal as a paste, slurry or solution as in a liquid medium such as water.

Sufficient amount of water in the mixture can be determined when the electrolyte exhibits an electrical resistivity of less than about $10^6$ ohm-centimeters. If the electrolyte is liquid, no added liquid medium may be necessary but is preferable particularly with strong mineral acids.

The presence of some water in the mixture of refractory metal and electrolyte is important to produce the ionic concentration of the protective metal and to permit the reactivity of the electrolyte to presumably engage in an ion exchange with the base metal.

It is believed that the present invention involves a multiplicity of occurrences and/or reactions which may occur successively, randomly, or substantially simultaneously. For instance, the production of the nascent surfaces on the refractory metal particle, the attaining of the necessary concentrations of refractory metal ions, the formation of the electrolyte ions, and the coating of the refractory metal particles with the electrolyte are all thought to occur sometime during the time span of the process of the present invention. It is possible that the foregoing conditions and reactions may be made to occur in random order during a single mixing step in the presence of sufficient moisture.

This single mixing or combined mixing and ageing step if carried out for 10 minutes to 30 days can substitute for the time required to achieve the nascent surfaces and the concentration of refractory metal ions, although, if the concentration of refractory metal ions is not found to be adequate, then remixing and/or further ageing time usually between 1 and 30 days may be required. The actual concentration of the refractory metal ions will be the test for the need for further mixing or ageing time.

The intimately mixed powders, paste, liquid, etc. of electrolyte with the refractory metal may then be applied by spraying the base metal, submerging, brushing, tumbling, sprinkling, or any suitable means of distribution or coating of the mixed refractory metal and electrolyte to provide a thin coat on the base metal.

For the economical treatment of small parts which is only one of the particular advantages of the present invention, a prepared mixture of the refractory metal having nascent surfaces and the electrolyte, having the required moisture content and refractory metal ion concentration, may be tumbled with the parts to be treated in a ball-milling machine without using any balls in order to attain an adequate coating of both the refractory metal and the electrolyte so as to accomplish the next step of this invention, the deposition of the refractory metal. For the wet mixture, the electrolyte is present between the surface of the base metal and the refractory metal, and acts in exactly the same manner as if the particles of the refractory metal had been coated with the electrolyte.

The temperature at which the substitution or replacing of the refractory metal for the base metal takes place may be ambient temperatures, or may be any convenient temperature. While the temperature is not critical for the performance and operability of the present invention, it does have the effect of increasing the rate of reaction with temperature rise. At ambient temperatures, it has been found that a time between about 1 and 168 hours and preferably 6 and 72 hours will be adequate to effect an impregnation or exchange of the refractory metal for the base material. Longer times are not critical and do not adversely affect the process. Shorter times may be feasible if an adequate reaction occurs. The temperature range may be 0° C. to 200° C., preferably between 10° C. and 100° C., and more particularly between 15° C. and 40° C. The lower limit of temperature is not critical and may be lower than 0° C. but this entails a longer reaction time.

The areal density of the mixed electrolyte and refractory metal as the protective material that may be applied to the base metal is not critical and may vary from about 0.5 refractory particles of protective coating/mm$^2$ to a complete even coating of the mixture on the surface of the base metal which would be about $10^6$ particles/mm$^2$ for a 1.0 micrometer particle size. Particles of 1 to 5 micrometers in size may have a concentration of these particles ranging from approximately $4\times10^4$ to $10^6$ particles/mm$^2$ for full coverage. With particles of approximately minus 325 mesh size (44 micrometer nominal maximum diameter) such as to include commercially available metal powders and an electrolyte in combination, the concentration of particles to be deposited on the base metal may vary from approximately 10 to $10^4$ particles/mm$^2$. The amount and the size of the refractory metal particles applied does determine the proximity of the particles and the size of the discrete particles thereafter actually deposited onto the base.

The Product

The drawing of the FIGURE is a composite schematic illustration of the various possible structures that may be found on the base metal 10 and within the near-surface region 12 defined by the planes A—A.

The character of the discrete particles 14 of refractory metal deposited within the near-surface region of the base metal is to a degree dependent upon the practice of this invention. For instance, there are refractory metal particles present in the near-surface region of the base of substantially the same shape and nominally of the some or somewhat smaller size compared to the particles in the powder or particulate form of the refractory metal initially entering the process of this invention. Such a relationship in size and shape is not present in prior art techniques such as electroplating and plasma arc spraying. This characteristic feature of the present invention has been supported by microscopic observations of both the refractory metal powder or particulate entering the process and the deposited refractory metal particles in the processed metallic bases. A plurality of such deposited particles are of such dimension not greater than about 2 micrometers and all such deposited refractory metal particles have been found to be within the size range of 0.01 micrometer to 100 micrometers.

Additionally there may be deposited in the near-surface region 12 of the base metal 10 a quantity of refractory metal particles 14 having dimension both greater and lesser than the nominal mean particle dimension of the refractory metal powder or particulate initially entering the process of this invention. Thus, for example, if the initial forms of the refractory metal particles entering the process of this invention are idiomorphic or blocky of mean dimension 1 micrometer, then the deposited refractory metal particles may be of this character and additionally exhibit both the form of large spheroidal particles up to 10 micrometers in diameter and small contiguous particles of mean dimension less than 0.2 micrometer. Although the deposited refractory metal particles 10 may take on such additional forms, it has been found that these deposited particles range in size from 0.01 micrometer to 100 micrometers and that a plurality of the deposited refractory particles have dimension less than about 2 micrometers.

The locations of the discrete deposited refractory metal particles are preferentially found at the grain boundaries, the pores or valleys of a microscopic nature in the near-surface region of the base metal, and/or in effect within any irregularity in the near-surface region of the base metal that may have been formed by previous physical or chemical action, as machining grooves 16, etc. The distribution of refractory metal particles upon essentially planar microscopic single-phase areas of the base metal is apparently spatially random. Similarly, the phenomenon of micro-electrolysis is believed to occur in an essentially spatially random fashion upon such planar portions of the base metal to form the initially discontinuous pattern of the deposited discrete refractory metal particles.

As the operation of this invention progresses, a plurality of these discrete refractory metal particles are deposited in a contiguous pattern to form clusters 18 of these particles randomly disposed upon the essentially planar areas 20 of the base metal. These clusters of particles are spaced from each other, and are preferentially formed at irregularities in the near-surface region of the base metal such as the machining grooves 16.

As the process reactions of this invention are carried to further stages of advancement as by increasing treatment time, or increasing treatment temperature, or the like, the preferentially and the randomly disposed clusters 18 of discrete particles 14 become contiguous to other proximal clusters and thus form microscopic (small scale) regions 22 of deposited refractory metal within the near-surface region of the base metal. Such microscopic regions of deposited refractory metal appear to be continuous because within said regions the base metal is obscured from view. These microscopic regions 22 of refractory metal are spaced from each other in random fashion but are preferentially formed at irregularities in the near-surface region of the base metal such as machining grooves 16 and the like.

As the process reactions of this invention are carried to still further stages of advancement and more particularly as the multiplicity of reacting areas is increased by increasing the areal density of discrete particles upon the substrate, the mutual refractory metal bonding processes become more evident. Both the perferentially and the randomly disposed microscopic refractory metal regions 22 become contiguous to other proximal microscopic regions of refractory metal as at 24 to produce macroscopic (large scale) regions 26 of deposited refractory metal within the near-surface region of the base metal. Such macroscopic regions 26 of deposited refractory metal appear to the unaided eye to be continuous as within such regions the base metal is obscured from view. These macroscopic regions of deposited refractory metal are spaced from each other and are apparently randomly disposed in the near-surface region of the base metal.

Subsequently, and with continued lateral growth of the refractory metal by the above-described processes, the entire base metal 10 becomes covered with and obscured by deposited refractory metal as shown at 28. Additionally, the refractory metal builds itself in a direction normal to the surface of the base, thus thickening the refractory metal layer at 30 and providing a coherent and apparently continuous layer 32 of refractory metal adherently bonded to and as an integral part of the base metal 10.

Such distribution and subsequent association of deposited discrete refractory metal particles as described above provide a pattern of deposition unlike any other metal deposition process, including especially electromechanical processes. For instance, metal sheet stock of mild steel when treated with the present invention appears to the unaided eye to have a continuous coating yet is able to withstand a bend of 140° about a ⅜ inch radius without visible cracks or rupture even at magnification of 3 diameters. This coating though apparently continuous actually has a discontinuous structure.

Thus, the treatment of a tool steel base by the process of this invention provides the deposition of discrete refractory metal particles in the form of randomly-spaced clusters of particles. These particle clusters are deposited within the near-surface region of the base metal and preferentially upon the essentially planar metallic matrix exposed between the carbide particles of this steel. The treatment of type SAE 1018 steel by the process of this invention provides a similar but more complex pattern of refractory metal particle deposition within the near-surface region of the base. In this instance, the refractory metal particles were deposited discretely in the form of randomly-spaced clusters of particles upon the essentially planar ferrite microconstitutent of the base and were additionally distributed preferentially upon the intercarbide ferritic portion of the pearlite microconstituent of the base metal. For both types of steels, the continuous metallic matrix phase was observed to be the preferred site for refractory metal particle deposition and in both cases, randomly-spaced clusters of discrete particle were observed to have been deposited upon the essentially planar portions of the continuous metallic matrix phase of the base.

The thickness of the build-up of the deposited particles that form an adherent coating that may be applied varies in accordance with the time, temperature and ion concentrations. Even an impressed current applied for a period during which the electrolyte or refractory metal is in contact with the base material may also affect the coating characteristics. Thickness beginning with molecular films that may be selectively sensibly continuous or discontinuous up to 0.5 mm in thickness may be deposited within the near-surface region of the base material. It should be understood that one of the unique features of this invention is the fact that the refractory metal is applied to and in part substitutes for or replaces a portion of the base material and, as such, there usually is no change in the dimension of the base metal detectable by ordinary shop practice measuring techniques. Only in the most advanced stage of deposition can a detectable dimensional change be noted.

Finally, and according to the particular practice of this invention, there may be present in the near-surface region of the base metal microscopic quantities of at least one corrosion product 24. These corrosion products are the solid chemical compounds, essentially insoluble in the electrolyte, formed as a result of any corrosion reaction in which the base metal is chemically attacked by the electrolyte and in a plurality of instances these compounds are composed essentially of cations from the base metal and anions from the electrolyte. Thus, the corrosion products may be evidenced in the form of base metal hydroxides, chlorides, nitrates, sulfates, cyanates, carbonates, acetates and the like or may alternatively be more complex base metal compounds as oxyhydrates, oxychlorides, thiocyanates and the like.

When present, the corrosion products tend to nucleate and grow in the near-surface region 12 of the base 10 and at those areas accessible to the electrolyte; specifically, at areas other than those where the refractory metal is in direct physical contact with the base. The essentially lateral growth of the corrosion products tends at least partially to surround as at 36, embed as at 38, partially embed as at 39 or entrap as at 40 the deposited refractory metal in the form of particles 14, clusters 18, the microscopic regions 22 as well as the macroscopic regions 26. As these corrosion products are adherent to the base metal, they are believed to provide enhanced adherence of the refractory metal particles to the base, especially by means of surrounding or entrapping the refractory metal particles.

The composite coating structure so produced is composed of refractory metal particles adherently bonded to the base metal, refractory metal particles surrounded or entrapped or made more adherent to the base by corrosion product and, additionally, some refractory metal particulate totally encapsulated by corrosion product. Such a composite structure increases the likelihood that certain of the refractory metal particles, especially those totally encapsulated by corrosion product, will be mechanically embedded or friction welded or the like to the base metal in its near-surface region as a natural result of forces generated when the coated part is put into service. In this sense, the composite coating acts as a reservoir to assure a continuing supply of refractory metal particulate adherent to the near-surface region of the base metal. Further, in some instances, the corrosion product itself will act as a lubricant to reduce friction and/or wear either through properties of itself or as a porous reservoir for common lubricants as oils, greases, graphite, molybdenum disulfide, and the like.

The preferred final step in the treatment of base metals in accordance with the present invention is a rapid washing with hot water followed by rapid air drying. This operation terminates the microelectrolytic action and removes nearly all ionized products and salts from the vicinity of the base metal substrate. The effluent wash liquid, usually water, contains valuable undeposited refractory metal particles which are desirable to recover and use in subsequent applications of this invention. Up to 99 percent of the total weight of refractory metal particles may be recovered by standard operations of decanting, sedimentation, centrifuging, and the like when they are applied to the effluent wash water, however, the particles of not all refractory metals are recoverable in this manner.

There are specific refractory metal-electrolyte combinations which unfortunately undergo mutual cementation subsequent to the washing cycle. This cementation process is undesirable as the product mass so formed is essentially unusable for recycling purposes and cannot be easily reformed into the particles. In such cases, it has been found that mineral acid treatments of the wash water may be employed in which the concentration of acid in the wash water is maintained between 1% and 10% by volume of the total in order to obviate the cementation process. For example, with the treatment mixture composed of tungsten metal powder as the refractory metal and calcium chloride as the electrolyte, it has been found that cementation may be obviated by the addition of hydrochloric acid to the level of approximately 5% by volume of the total effluent wash water after which time the effluent may be rewashed and decanted or centrifuged to recover the tungsten powder which has not been consumed in the treating reaction. The concentration of the hydrochloric acid used to achieve the proper wash water concentration is not critical.

The following are examples of the process of the present invention:

EXAMPLE 1

This invention is particularly adaptable to metal parts that are subject to a high degree of wear, particularly such as small parts used for textile machinery in which miles of yarn or textile fibers are to be passed through or over metal parts, thus subjecting such parts to great wear. The steel parts known as travelers when coated with refractory metal such as tungsten in accordance with the present invention have been found to last approximately 10 times longer in actual use than similar untreated commercial parts. Further, dimensional changes, if any, are so slight with regard to the travelers as neither to interfere with normal spinning operations nor to degrade the yarn quality.

To apply tungsten metal as a wear-resistant refractory material to the near-surface region of high-carbon steel textile machine travelers, tungsten powder of a pure form is used although the purity is not particularly critical. This powder is a minus 325 mesh size indicating that the tungsten metal particles are of maximum dimension 45 micrometers and that many of the particles are much smaller than this size, down to approximately 1 micrometer maximum dimension. This dry tungsten powder is mixed with dry anhydrous calcium chloride powder of commercial particle size in the ratio 1 weight part of $CaCl_2$ to 10 weight parts of tungsten powder. These two powders are then mixed or co-milled for a period of approximately 24 hours in a jar-type ball mill, using ¼" to ½" porcelain balls in a porcelain jar, although the use of a mortar and pestle for the same period of time is also satisfactory. During this co-milling operation it is believed that nascent surfaces are provided on the refractory tungsten particles, the particle size of the $CaCl_2$ is reduced and the $CaCl_2$ is deposited or smeared upon the surfaces of the tungsten metal powder particles.

The so-milled mixture of dry powders is then allowed to stand for approximately 20 hours in contact with humid air of 60% relative humidity and because of the hygroscopic nature of the $CaCl_2$, water is taken on by this mixture in an amount equal to approximately 10% to 20% of the total weight of the wetted mixture. At this point, the bulk of the $CaCl_2$ has dissociated into ions and a small amount of the tungsten metal powder has also entered solution in ionic form producing an equivalent concentration of approximately 3,000 to 10,000 milligrams of refractory metal ion per liter of the liquid phase of the mixture. The wetted and aged mixture is then applied as a slurry by co-tumbling the mixture and the travelers, said parts having been previously cleaned in a $CCl_4$ bath to remove grease, oil, or other foreign matter, so as to expose the near-surface region of the steel base material of the travelers of the action of and contact with the electrolyte and refractory metal mixture. Within 24 hours at room temperature, the refractory metal powder particles and the refractory metal ions acting in concert with the electrolyte and the steel base produce a deposit of metallic tungsten particles in the near-surface region of the steel substrate of the traveler. The final step in processing the steel travelers described above is a rapid washing with hot (80° to 100° C.) water followed by a rapid air drying. This operation terminates the micro-electrolytic action and removes ionized products and salts from the vicinity of the steel substrate.

The resultant product is a steel part in whose near-surface region is deposited tungsten metal in the form of randomly-spaced clusters of discrete particles. This spatially discontinuous deposit of tungsten particles is infiltrated by a solid corrosion product, believed to be composed essentially of hydrated ferric oxides, deposited as a contiguous mass in the near-surface region of the steel base and adherent to it. This corrosion product surrounds, entraps, and partially overlays the deposited tungsten particles to form an adherent composite corrosion product layer upon the steel base.

The coated steel surfaces appear to the unaided eye to be uniformly coated and darkened, exhibiting a macroscopic grey color and being preferentially adsorbent to visible electromagnetic radiation in the range of wavelengths between 580 and 610 nanometers as compared to an uncoated base. Such quality of treated surfaces provides both enhanced adsorption and enhanced emission of electromagnetic radiation, the latter being of special import with regard to the dissipation of radiant heat.

The coated steel surfaces produced by the practice of this invention are found to possess wear-resistant qualities, abrasion-resistant qualities and corrosion-resistant qualities far superior to those of similar untreated parts. Importantly, no noticeable dimensional change of the part takes place during the above-described treatment as determined by standard machine shop practice.

EXAMPLE 2

This invention is also applicable to metal parts that are subject to a high degree of wear, particularly high-strength low-alloy steel parts such as gears used in all types of industrial and commercial machinery. Such parts present mating surfaces through which heavy loads are transmitted, the parts thus being subject to great wear under heavy-load conditions. Steel parts known as bevel gears, when surface treated with refractory metal such as tungsten, in accordance with the present invention have been found to be serviceable for a period approximately three times longer than similar untreated commercial parts. Further, dimensional changes, if any, are so slight with regard to the bevel gears as to require neither remachining of the gears nor any adjustment or realignment of other components of the machinery.

To apply tungsten as a wear-resistant refractory metal to the surfaces of heat-treated low-alloy steel bevel gears, the wetted and aged mixture of tungsten and $CaCl_2$ is prepared exactly as outlined in EXAMPLE 1 above. This mixture is then applied as a slurry by painting upon the wearing surfaces of the gears in such manner to provide an areal density of approximately $10^3$ refractory metal particles per $mm^2$ on the surface of the cleaned steel gears. Within 24 hours at room temperature, the refractory metal ions acting in concert with the electrolyte and the low-alloy steel base material produce a deposit of metallic tungsten particles in the near-surface region of the steel gear. The part is then washed and dried as indicated in EXAMPLE 1 above.

The resultant product is a steel part in whose near-surface region is deposited tungsten metal particles in discrete form and which give a macroscopic blue cast to the treated part. The coated steel surfaces possess wear-resistant and abrasion-resistant qualities under heavy load which are far superior to those of similar untreated commercial parts. Importantly, no noticeable dimensional change of the part, as determined by standard machine shop practice, takes place during the above-described treatment.

Laboratory sliding wear tests of similarly treated type SAE 1018 low-carbon steel plates indicated that for a load of 0.5 Kg and a speed of 120 cm/sec the treated material was approximately 250 times more resistant to wear than similar untreated specimens, as measured by weight loss. The treated material used in these 1-hour accelerated wear tests had the same macroscopic appearance as the above-described treated low-alloy bevel gears.

EXAMPLE 3

This invention is also applicable to metallic parts that are specifically designed as wear surfaces, particularly relatively large parts used as wear-bearing surfaces in reciprocating machinery. The selection of material of construction for such parts will depend upon particulars of machine design and personal preference but may include materials such as low-carbon steel, white cast iron, tool steel, or selected non-ferrous alloys. The bearing surfaces, when coated with refractory metal such as tungsten, in accordance with the present invention have been found to be more wear resistant than similar untreated bearing surfaces.

To apply tungsten as a wear-resistant refractory material to the surfaces of the parts, tungsten powder of a minus 325 mesh size is used. The dry tungsten powder is mixed with dry anhydrous $CaCl_2$ of a commercial particle size and the powders are mixed and co-milled as described in EXAMPLE 1 above.

The co-milled mixture of dry powders is then sprinkled by sifting onto the cleaned wear bearing surfaces in such manner so as to provide an areal density of approximately $3\times10^3$ refractory metal particles per $mm^2$ on the surfaces. Such wear bearing surfaces are then exposed at 40° C. to air of 40 to 50% relative humidity for a period of 20 hours. Within this 20-hour period, the refractory metal powder particles and the refractory metal ions acting in concert with the electrolyte and the wear-bearing surfaces produce a deposit of metallic tungsten particles in the near-surface region of these surfaces.

The resultant product is a part in whose near-surface region is deposited tungsten metal particles in both discrete and agglomerated form and distributed throughout the near-surface region of these parts. The treated surfaces possess wear-resistant qualities far superior to those of similar untreated parts, thus for example SAE 1018 steel, 484 FM tool steel, and 7075-T651 aluminum alloy exhibit resistances to wear which are approximately 970, 16, and 4 times, respectively, greater than similar untreated parts. Importantly, only minor dimensional changes of the part take place during the above-described treatment, such changes in no way limited the direct serviceability of such parts as wear-bearing surfaces.

EXAMPLE 4

This invention is also applicable to metallic parts such as those described in EXAMPLES 2 or 3 above, or for any other large parts, when the surface to be treated with refractory metal such as tungsten, in accordance with the present invention, is made the negative pole of an electrolytic cell. To apply tungsten as a wear-resistant refractory metal to the surfaces of such parts, the wetted and aged mixture of tungsten and calcium chloride is prepared exactly as outlined in EXAMPLE 1 above. A relatively large amount of this mixture is then placed in a stainless steel vessel which is to serve as the positive pole of an electrolytic cell. The wetted mixture in this instance serves as the "electrolyte" of the electrolytic cell. Given the polarities indicated, a D.C. potential or approximately 1 volt is applied across the cell (stainless steel-"electrolyte"-substrate to be coated). Electric current is thus allowed to flow for a period of approximately 6 hours after which time it is found that the substate acquires the typical blue cast associated with the surfaces produced in accordance with the EXAMPLES 1-3 where no current has been applied. It is seen that the application of current in this instance accelerates the deposition of discrete particles. This discontinuous deposit is unlike the continuous coatings produced by commercial electroplating processes.

Laboratory wear plates of SAE 1018 steel when treated as indicated above possess a near-surface region in which is deposited tungsten metal particles in the form of randomly-spaced clusters of particles. These treated surfaces possess wear resistant qualities under heavy load which are in excess of 1000 times superior to those of similar untreated wear plates. Importantly, no noticeable dimensional change of the part, as determined by standard machine shop practice, takes place during the above-described treatment.

As a further example of the present invention, using various styled loopers composed of hard steel, cast iron, tungsten steel, and chromium steel, the treatment is as follows:

EXAMPLE 5

Differently styled and shaped loopers and needles of hardened carbon steel and some of chromium steel and tufting knives of a tungsten steel are to be exposed to a mixture of 1½ cubic centimeters of hydrochloric acid combined with 20 grams of powdered minus 325 mesh tungsten. The hydrochloric acid forms the electrolyte and is to be mixed one part acid to five parts water. The hydrochloric acid and tungsten mixture before contact with the parts to be treated is mulled to a uniform mixture for 24 hours finally taking the form of a dampened powder. The moisture content is adjusted to be 9% by weight of the total mixture. Upon a further 24 hours ageing period the tungsten ion concentration should be at least 5,000 mg. per liter of solution. The mixed product is then to be sifted at 200 particles per $mm^2$, evenly at 25° C. over the surfaces of the loopers, the tufting knives and needles, and permitted to stand for 12 hours in open trays. At the end of the period, all the pieces will be found to have a somewhat darker cast. As the end of the reaction period, the pieces will be found to have longer wearing abrasion-resistant surfaces than similar untreated pieces.

EXAMPLE 6

Loopers, needles and knives composed of the same base materials as in EXAMPLE 5 were treated with a prepared mixture of sodium hydroxide and tungsten. Dry sodium hydroxide in an amount of 10 parts by weight and 80 parts by weight of a finely divided tungsten were mulled for 24 hours. Water in the amount of 10 parts by weight of the mixture was added and the mixture was mulled for an additional 24 hours. This mixture was applied evenly over the loopers, needles and knives. After 15 hours, the parts were found to have a dark cast, and those parts tested were found to have greater wear-resistant qualities.

EXAMPLE 7

Steel, cast iron, and bronze surfaces were treated with a preprocessed mixture of tantalum powder and ammonium sulfate. The dry mixture of tantalum and ammonium sulfate in a weight ratio of 4:1 was mulled for a day. Water in the amount of 10% was added and mulling was continued to produce a useful tantalum ion concentration. The mixture is to be applied in a thin light coating to these metal surfaces for 24 hours, except the bronze surfaces which are allowed 72 hours. The entire process is then repeated upon the previously coated surfaces except that titanium and ammonium chloride are to be substituted for the tantalum and ammonium sulfate. The plural coated surfaces of tantalum and titanium were found to have greater abrasion resistance than the untreated surfaces.

EXAMPLE 8

A commercial grade of anhydrous sodium sulfite is used with boric acid ($H_3BO_3$) U.S.P. both in the form of a powder. A mixture of equal parts by weight of the boric acid and sodium sulfite by weight was made. These combined materials are added to minus 325 mesh molybdenum powder in the amount of 23% by weight molybdenum. Moisture is added if necessary to the 7% by weight level. This combination of electrolyte and refractory metal was processed by mulling, as heretofore described, for a period of 48 hours.

The application was made to fabricated aluminum article known to the spinning industry as a "flyer". The article was cleaned with soap and water. The flyer has presented a problem for other types of treatment because of an interior surface. Many of the flyers which were to be treated had previously been discarded as useless because old and worn flyers are found to exhibit what is called "tagging". This is a cropping out of a fetlock of roving sliver in the open slot which runs the length of the flyer tube affecting the flow of the sliver and, consequently, the entire operation of a roving frame which may contain as many as 120 flyers.

Application of the combined powders was made by brush and by dipping the part in the mulled mixture. An even, thin coating was easily secured and the part was then allowed 24 hours for reaction with the mixture. A thorough cleaning of the flyers was made at the end of 24 hours.

Flyers, so treated, were returned to the frames and were found to perform better than new flyers. The treatment also minimized "tagging".

In all of the above examples, the refractory metal particle is found to be associated with the base metal in such a manner that it does not fall out through any mechanical action including hammering or other severe blows. The refractory metal is deposited in a substantially permanent and fixed manner. The refractory metal is also found to usually have a thickness of between molecular films and 0.5 mm. This thickness may vary somewhat but is designed ideally not to be substantially thicker in order to retain the original dimensions of the base material as measured by standard shop practice.

SPECIAL DEFINITIONS

Various terms are used throughout the description and claims of the present invention. The following are definitions of three terms. Terms not defined herein are to have their ordinary meaning.

Deposit: includes the chemical, mechanical or physical attachment of one material to another and specifically includes coating, bonding, adhering and embedding.

Refractory metal ion concentration: is the concentration of refractory metal ions in aqueous solution, on a weight basis, considered as if the metal itself had ionized to a univalent or multivalent state. It is recognized that this simple concept of ionization may not represent the actual case, thus, for example, tungsten in solution may appear as the tungstate ion, where tungsten is intimately associated with oxygen.

Near-surface region: let the base metal and its immediate environment be regarded as the system in question. Parallel to the actual boundary between the base metal and the environment, consider two surfaces, one on each side of the actual boundary and situated far enough from that boundary so that all irregularities and inhomogeneities of the base metal surface will be included entirely between them. The volume included between these two surfaces is the "near-surface region" of the base metal. This definition is patterned after that J. Willard Gibbs (see C. E. Reid, "Principles of Chemical Thermodynamics", Reinhold Publishing Company, New York, 1960). In structural details, the near-surface region will be dependent upon the practice used to prepare the surface, but in general, all such surfaces would have characteristic openings or crevices or pores of irregular size or shape as follows: a width or lateral dimension between 0.02 micrometer and 1 mm and a depth of approximately 0.02 micrometer to 200 micrometers, irregularly spaced throughout the surface of the article to be treated. Substantially planar surfaces of base material remain between these openings. The openings may or may not appear to have an undercut and therefore have an overhanging portion of the surface extending into the openings of the base material. All such geometrical structural details are here defined as being within the near-surface region.

We claim:

1. An article of relatively low wear-resistant base metal coated with a refractory metal comprising:
   - a base metal of relatively low wear resistance,
   - a near-surface region of said base metal,
   - a refractory metal having a melting point of at least 1490° C. deposited within said near-surface region and being adherent to said base metal,
   - said refractory metal being deposited as discrete particles,
   - a plurality of said particles being contiguous to form clusters and,
   - said clusters of said particles of refractory metal being spaced from each other to form an adherent wear-resistant discontinuous coating of said discrete particles of refractory metal on said base metal.

2. The article of claim 1 wherein, a plurality of said refractory particles are idiomorphic in form and wherein a plurality of said particles of said form have dimensions less than 2 micrometers.

3. The article of claim 1 wherein, a plurality of said refractory particles are equiaxial in form and wherein a plurality of said particles of said form have dimensions less than 10 micrometers.

4. The article of claim 1 wherein, a plurality of said refractory particles are acicular or dendritic in form and wherein a plurality of said particles of said form have dimensions less than 2 micrometers.

5. The article of claim 1 wherein, said refractory metal is an admixture of (a) idiomorphic particles a plurality of which have dimensions less than 2 micrometers and (b) equiaxial particles a plurality of which have dimensions less than 10 micrometers.

6. The article of claim 1 including, a solid corrosion product of said base metal formed within said near-surface region and being adherent to said base metal, said corrosion product at least partially surrounding other refractory particles in locations wherein said other particles are not adherent to said base metal whereby to provide additional wear resistant coating from said other refractory particles.

7. The article of claim 6 wherein, a plurality of said refractory particles are idiomorphic in form and wherein a plurality of said particles of said form have dimensions less than 2 micrometers.

8. The article of claim 6 wherein, a plurality of said refractory particles are equiaxial in form and wherein a plurality of said particles of said form have dimensions less than 10 micrometers.

9. The article of claim 6 wherein, a plurality of said refractory particles are acicular or dendritic in form and wherein a plurality of said particles of said form have dimensions less than 2 micrometers.

10. The article of claim 6 wherein, said refractory metal is an admixture of idiomorphic particles, a plurality of which have dimensions less than 2 micrometers and equiaxial particles, a plurality of which have dimensions less than 10 micrometers.

11. The article of claim 1 including, a plurality of said clusters further being contiguous to form a plurality of microscopic refractory metal regions, and at least some of said regions being spaced from each other.

12. The article of claim 11 including, solid corrosion product of said base metal formed within said near-surface region and being adherent to said base metal at areas not occupied by said microscopic regions or by said refractory particles, said corrosion product at least partially surrounding said microscopic regions and firmly maintaining other refractory particles not adherent to said base metal securely positioned to form an additional wear resistant coating.

13. The article of claim 1 including, a plurality of said clusters being contiguous to form microscopic refractory metal regions and, a plurality of said microscopic regions being contiguous to form macroscopic regions of said refractory metal upon said base metal.

14. The article of claim 13 including, a solid corrosion product of said base metal formed within said near-surface region and being adherent to said base metal, said corrosion product at least partially surrounding other refractory particles in locations wherein said other particles are not adherent to said base metal whereby to provide additional wear resistant coating from said other refractory particles.

15. The article of claim 13 including, solid corrosion product of said base metal formed within said near-surface region and being adherent to said base metal at areas not occupied by said microscopic regions and firmly maintaining other refractory particles not adherent to said base metal securely positioned to form an additional wear resistant coating.

16. The article of claim 1 including, said near-surface region of said base metal having characteristic irregularities, openings, crevices, or pores of irregular size or shape, a plurality of said clusters being contiguous to form microscopic refractory metal regions and, a plurality of said microscopic regions being produced in said near-surface region at said characteristic irregularities whereby to provide for said near-surface region sensible coverage in part by said microscopic regions.

17. The article of claim 16 including, a solid corrosion product of said base metal formed within said near-surface region and being adherent to said base metal, said corrosion product at least partially surrounding other refractory particles in locations wherein said other particles are not adherent to said base metal whereby to provide additional wear resistant coating from said other refractory particles.

18. The article of claim 16 including, a solid corrosion product of said base metal formed within said near-surface region and being adherent to said base metal at areas not occupied by said microscopic regions or by said refractory particles and, said corrosion product at least partially surrounding said microscopic regions and firmly maintaining other refractory particles not adherent to said base metal securely positioned to form an additional wear resistant coating.

19. The article of claim 13 including said macroscopic regions being contiguous to form a macroscopically continuous coating of said refractory metal upon said base metal.

20. The article of claim 16 including, a plurality of said microscopic regions being contiguous to form macroscopic regions of said refractory metal upon said base metal, and including a solid corrosion product of said base metal formed within said near-surface region and being adherent to said base metal, said corrosion product at least partially surrounding refractory metal in locations wherein said refractory metal is not adherent to said base metal whereby to provide additional wear resistant coating from said other refractory particles.

21. The article of claim 13 including, solid corrosion product of said base metal formed within said near-surface region and being adherent to said base metal at areas not occupied by said microscopic or macroscopic regions or by said refractory particles, said corrosion product at least partially surrounding said regions and firmly maintaining other refractory particles not adherent to said base metal securely positioned to form an additional wear resistant coating.

22. The article of claim 1 including, said refractory metal particles being metallically bonded to said base metal in said near-surface region without any sensible indication of preferred orientation or stresses in said refractory metal particles or said base metal.

23. The article of claim 1 wherein, said article being more adsorbent to electromagnetic radiation of visible and infrared character than is said base metal in its technically clean state and uncoated.

24. The article of claim 1 wherein, said article being of macroscopic grey color and being more adsorbent to visible electromagnetic radiation in the range of wavelengths between 580 and 610 nanometers compared to an uncoated base.

25. The article of claim 1 wherein, said metal for the base material is selected from aluminum, chromium, cobalt, copper, iron, magnesium, nickel, tin, titanium and the alloys thereof including, steels, cast irons, brasses, bronzes, and solders.

26. The article of claim 1 wherein, the refractory metal is selected from boron, chromium, cobalt, iridium, molybdenum, niobium, osmium, paladium, platinum, rhenium, rhodium, ruthenium, tantalum, thorium, titanium, tungsten, vanadium, yttrium, zirconium, and alloys thereof.

27. The article of claims 6, 14, 15, 17, 18, 20 or 21 including, a reservoir formed from said corrosion product surrounding refractory metal particles, said reservoir providing a continual supply of said particles to the near surface of said metal.

28. The article of claims 6, 14, 15, 17, 18, 20 or 21 including, said corrosion product being porous and containing a lubricant.

29. The article of claim 27 including, said corrosion product being porous and containing a lubricant.

30. An article of relatively low wear-resistant base metal coated with a refractory metal comprising:

a base metal of relatively low wear resistance, a near-surface region of said base metal, a refractory metal having a melting point of at least 1490° C. deposited within said near-surface region and being adherent to said base metal, said refractory metal being at least in part in contact with the base metal and deposited as discrete particles, said discrete particles forming a discontinuous coating of said discrete particles of refractory metal, a plurality of said particles being contiguous to form clusters and, said clusters of said particles of refractory metal being spaced from each other to form an adherent wear-resistant coating on said base metal.

* * * * *